US009217269B2

(12) United States Patent
Lobkovich et al.

(10) Patent No.: US 9,217,269 B2
(45) Date of Patent: Dec. 22, 2015

(54) HINGE ASSEMBLY

(71) Applicant: GM GLOBAL TECHNOLOGY OPERATIONS LLC, Detroit, MI (US)

(72) Inventors: Thomas M. Lobkovich, Sterling Heights, MI (US); Christine M. Krolewski, Washington, MI (US); Allan L. Watson, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 14/268,515

(22) Filed: May 2, 2014

(65) Prior Publication Data

US 2015/0315831 A1 Nov. 5, 2015

(51) Int. Cl.

| | |
|---|---|
| ***E05D 15/32*** | (2006.01) |
| ***E05D 3/06*** | (2006.01) |
| ***E05D 15/10*** | (2006.01) |
| ***E05D 5/10*** | (2006.01) |
| ***E05D 1/00*** | (2006.01) |

(52) U.S. Cl.

CPC ..... *E05D 15/1005* (2013.01); *E05D 1/00* (2013.01); *E05D 5/10* (2013.01)

(58) Field of Classification Search

CPC ..... E05Y 2900/50; E05Y 2900/531; E05Y 2900/532; E05Y 2201/638; E05D 11/06; E05D 11/062; E05D 11/1057; E05D 3/10; E05D 3/06; E05F 1/1292; E05F 1/1238; E05C 17/38; B60J 7/047; B60J 5/0468

USPC ..... 16/370, 366, 368, 369, 286, 287, 288, 16/282; 296/146.12, 190.11

See application file for complete search history.

(56) References Cited

U.S. PATENT DOCUMENTS

| | | | | |
|---|---|---|---|---|
| 3,095,600 | A * | 7/1963 | Bretzner | 16/224 |
| 6,183,039 | B1 * | 2/2001 | Kohut et al. | 296/155 |
| 6,382,705 | B1 * | 5/2002 | Lang et al. | 296/146.12 |
| 6,606,763 | B1 * | 8/2003 | Bruckner | 16/366 |
| 7,896,425 | B2 * | 3/2011 | Elliott et al. | 296/146.12 |
| 2002/0073507 | A1 * | 6/2002 | Presley | 16/333 |
| 2006/0028049 | A1 * | 2/2006 | Lang et al. | 296/146.11 |
| 2006/0175863 | A1 * | 8/2006 | Evans | 296/100.08 |
| 2008/0271936 | A1 * | 11/2008 | Kuntze et al. | 180/90.6 |
| 2009/0051194 | A1 * | 2/2009 | Elliott et al. | 296/146.11 |
| 2009/0271949 | A1 * | 11/2009 | Sprague et al. | 16/382 |
| 2010/0171336 | A1 * | 7/2010 | Elliott et al. | 296/146.12 |
| 2010/0301631 | A1 * | 12/2010 | Scott et al. | 296/146.12 |
| 2011/0035903 | A1 * | 2/2011 | Sims | 16/293 |

(Continued)

FOREIGN PATENT DOCUMENTS

| | | | |
|---|---|---|---|
| DE | 9302381 | U1 | 3/1994 |
| DE | 102010018302 | A1 * | 5/2011 |
| JP | 08004400 | A * | 1/1996 |

*Primary Examiner* — Chuck Mah

(74) *Attorney, Agent, or Firm* — Quinn Law Group, PLLC

(57) ABSTRACT

A hinge assembly includes a first bracket and a second bracket. The first bracket defines a first bracket surface and a second bracket surface opposite the first bracket surface. The hinge assembly further includes a first link pivotally coupled to the first and second brackets. The first link extends along a first longitudinal axis. The hinge assembly further includes a first, second, third, and fourth links pivotally coupled to the first and second brackets. Each of the first, second, third, and fourth links is pivotally coupled to the first and second brackets such that the second bracket is movable relative to the first bracket between a first bracket position and a second bracket position.

15 Claims, 2 Drawing Sheets

(56) References Cited

U.S. PATENT DOCUMENTS

2011/0162170 A1* 7/2011 Morishita et al. ..... 16/319
2012/0000723 A1* 1/2012 Anliker et al. ..... 180/235
2013/0074286 A1* 3/2013 Hall et al. ..... 16/276

* cited by examiner

HINGE ASSEMBLY

TECHNICAL FIELD

The present disclosure relates to a hinge assembly.

BACKGROUND

A hinge assembly can movably couple a first component to a second component. For example, in a vehicle, a hinge assembly can movably couple a door to a vehicle body.

SUMMARY

It is useful to develop a kinematically stable hinge assembly capable of movably coupling two components, thereby allowing the components to move relative to each other as desired while the hinge assembly maintains its structural integrity. Specifically, it is useful to develop a hinge assembly that provides kinetic stability to a vehicle door regardless of the direction of the forces applied to the vehicle door in order to open the vehicle door. In an embodiment, the hinge assembly includes a first bracket and a second bracket movably coupled to the first bracket. The first bracket defines a first bracket surface and a second bracket surface opposite the first bracket surface. The hinge assembly further includes a first link pivotally coupled to the first and second brackets. The first link extends along a first longitudinal axis. The hinge assembly further includes a second link pivotally coupled to the first and second brackets. The second link extends along a second longitudinal axis and is substantially parallel to the first link. The second longitudinal axis is spaced from the first longitudinal axis along a first direction orthogonal to the first bracket surface and a second direction perpendicular to the first direction. The hinge assembly includes a third link pivotally coupled to the first and second brackets. The third link extends along a third longitudinal axis and is substantially parallel to the first and second links. The third longitudinal axis is spaced from the fourth longitudinal axis along the first direction. The hinge assembly includes a fourth link pivotally coupled to the first and second brackets. The fourth link extends along a fourth longitudinal axis and is substantially parallel to the first, second, and third links. The fourth longitudinal axis is spaced from the third longitudinal axis along the second direction. Each of the first, second, third, and fourth links is pivotally coupled to the first and second brackets such that the second bracket is movable relative to the first bracket between a first bracket position and a second bracket position.

The present disclosure also relates to a vehicle including the hinge assembly described above. As discussed above, the hinge assembly includes a first bracket, a second bracket, and first, second, third and fourth links. The vehicle includes a vehicle body coupled to the first bracket and a vehicle panel (or any other moveable vehicle component such as a vehicle door) coupled to the second bracket. Accordingly, the hinge assembly allows the vehicle panel to move relative to the vehicle body between an open position and a closed position. In particular, each of the first, second, third, and fourth links pivotally interconnects the vehicle panel and the vehicle body through the first and second brackets such that the vehicle panel (or any other moveable vehicle component) is movable relative to the vehicle body between the closed position and the open position.

The above features and advantages and other features and advantages of the present invention are readily apparent from the following detailed description of the best modes for carrying out the invention when taken in connection with the accompanying drawings.

DETAILED DESCRIPTION

Figure 1:
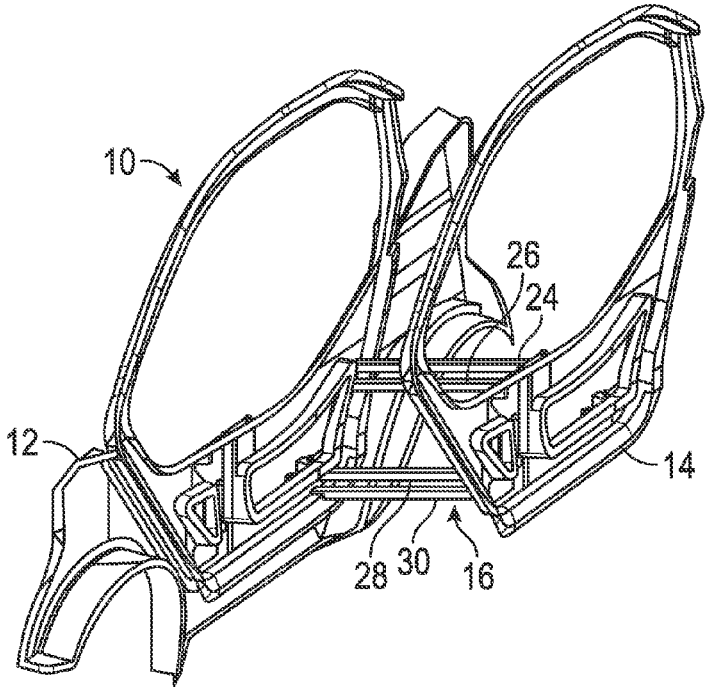
FIG. 1 is a schematic, perspective view of part of a vehicle including a vehicle door (or any other moveable vehicle component), a vehicle body, and a hinge assembly movably coupling the vehicle door to the vehicle body, wherein the vehicle door is in an open position.
Figure 2:
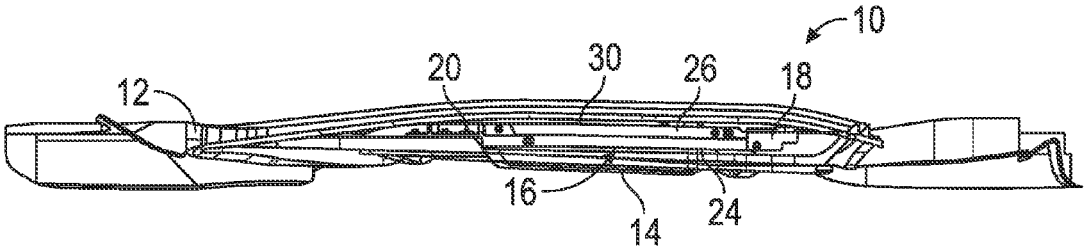
FIG. 2 is a schematic, top view of the vehicle door (or another movable vehicle component), the vehicle body, and hinge assembly shown in FIG. 2, wherein the vehicle door (or another movable vehicle component) is in a closed position.

Referring to the Figures, wherein like reference numbers correspond to like or similar components throughout the several views, FIGS. 1 and 2 schematically illustrate part of a vehicle 10 including a vehicle body 12, a vehicle door 14, and a hinge assembly 16 movably coupling the vehicle door 14 to the vehicle body 12. The hinge assembly 16 allows the vehicle door 14 to move between a first or closed position (FIG. 2) and a second or open position (FIG. 1). For example, the hinge assembly 16 can pivotally couple the vehicle door 14 to the vehicle body 12. As such, the vehicle door 14 can pivot relative to the vehicle body 12 between a first or closed position (FIG. 2) and a second or open position (FIG. 1). Although the hinge assembly 16 is illustrated coupling vehicle components, it is contemplated that the hinge assembly 16 can movably couple any two components. Accordingly, the vehicle body 12 may be referred to as the first component, and the vehicle door 14 may be referred to as a second component.

Figure 3:
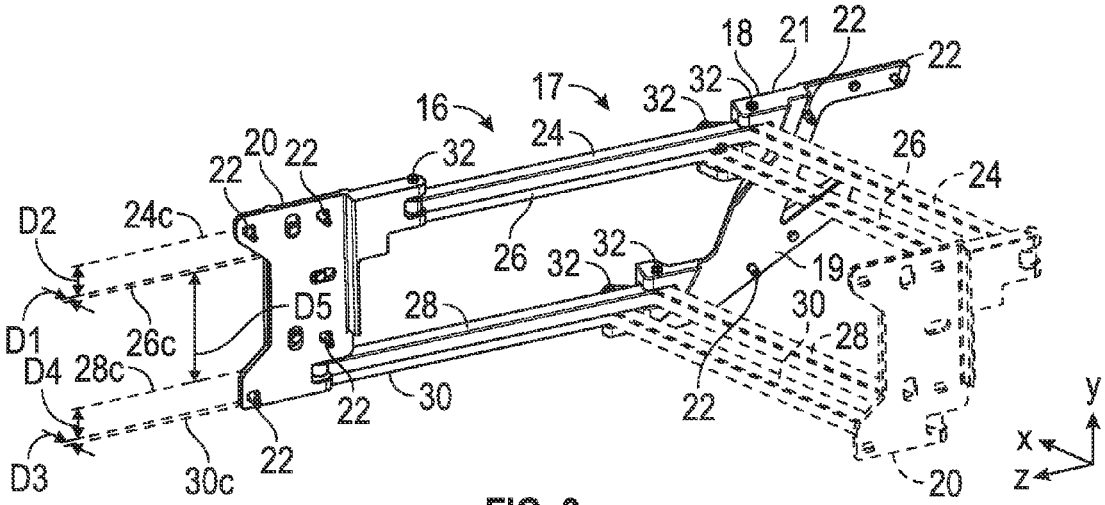
FIG. 3 is a schematic, perspective view of a hinge assembly shown in FIG. 1.

With reference to FIG. 3, the hinge assembly 16 includes a first bracket 18 and a second bracket 20 movably coupled to each other. The first bracket 18 may be coupled to the vehicle body 12 (FIG. 1) such that the first bracket 18 remains stationary relative to the vehicle body 12. The second bracket 20 may be coupled to the vehicle door 14 (FIG. 1) such that the second bracket 20 remains stationary relative to the vehicle door 14. Fasteners 22, such as screws or bolts, may couple the first bracket 18 to the vehicle body 12 (FIG. 1) and the second bracket 20 to the vehicle door 14 (FIG. 1). The first and second brackets 18, 20 may be substantially planar and are wholly or partly made of a substantially rigid material, such as metal. The first bracket 18 defines a first bracket surface 19 and a second bracket surface 21 opposite the first bracket surface 19. A first direction X is defined as being orthogonal to the first and second bracket surfaces 19, 21. A second direction Y is defined as being perpendicular to the first direction X. A third direction Z is defined as being perpendicular to the first direction X and second direction Y. The hinge assembly 16 may also be used to movably couple any vehicle panel, such as the vehicle door 14, to the vehicle body 12. Accordingly, reference number 14 also represents a vehicle panel.

Figure 4:
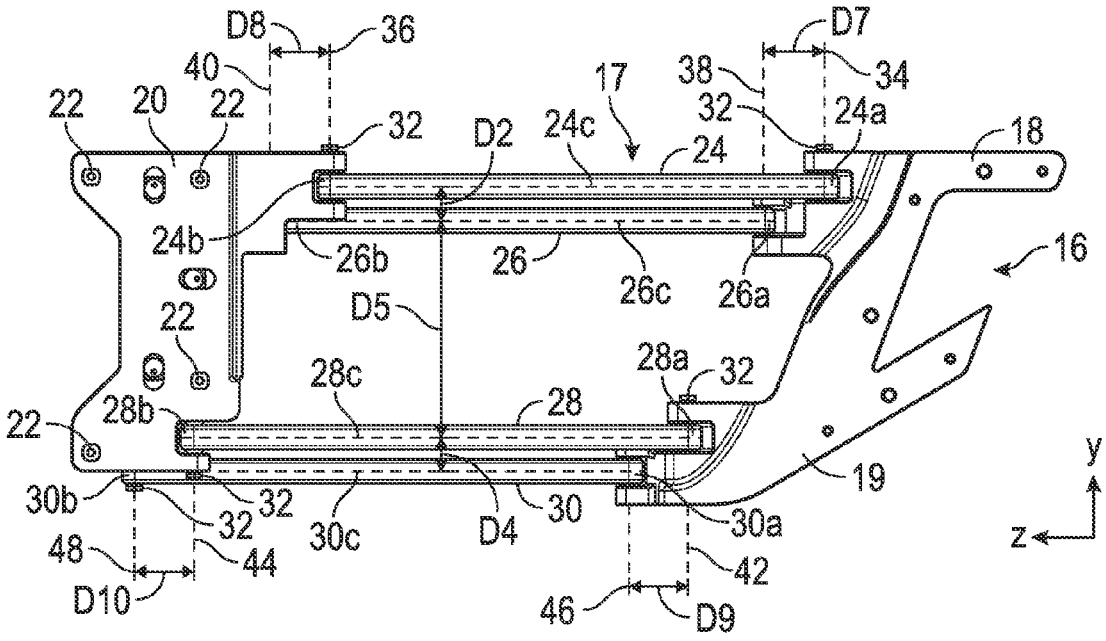
FIG. 4 is a schematic, front view of the hinge assembly of FIG. 1.
Figure 5:
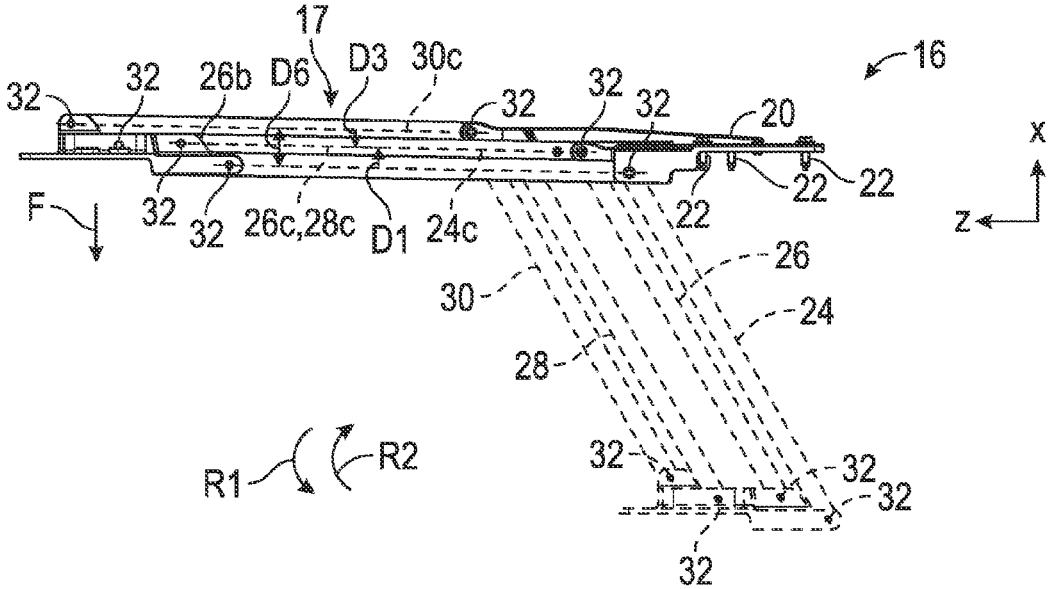
FIG. 5 is a schematic, top view of the hinge assembly of FIG. 1.

With reference to FIGS. 3-5, the hinge assembly 16 further includes a first link 24, a second link 26, a third link 28, and a fourth link 30 movably coupled to the first and second brackets 18, 20. Each of the first, second, third, and fourth links 24, 26, 28, 30 is pivotally coupled to the first and second brackets 18, 20 (FIG. 1) such that the second bracket 20 is movable relative to the first bracket 18 between a first bracket position (solid lines) and a second bracket position (dashed lines). Because of their pivotal connection to the first and second brackets 18, 20, the first, second, third, and fourth links 24, 26, 28, 30 can move simultaneously relative to the first bracket 18 between a first link position (shown in solid lines) and a second link position (shown in dashed lines). The first, second, third, and fourth links 24, 26, 28, 30 are in the first link position when the second bracket 20 is in the first bracket position. Further, the first, second, third, and fourth links 24, 26, 28, 30 are in the second link position when the second bracket 20 is in the second bracket position. In the depicted embodiment, pivot pins 32 (or any other suitable fastener or joint) can pivotally couple the first, second, third, and fourth links 24, 26, 28, 30 to the first and second brackets 18, 20. The pivot pins 32 may be part of a knuckle joint. The first, second, third, and fourth links 24, 26, 28, 30 are substantially parallel to each other so as to maintain the hinge assembly 16 kinematically stable regardless of the direction or location of the forces applied to the second bracket 20.

Each of the first, second, third, and fourth links 24, 26, 28, 30 may be a one-piece structure and is wholly or partly made of a substantially rigid material, such as metal or a rigid polymer. Further, each of the first, second, third, and fourth links 24, 26, 28, 30 defines a respective first link end 24*a*, 26*a*, 28*a*, 30*a* and a second link end 24*b*, 26*b*, 28*b*, 30*b* opposite the corresponding first link end 24*a*, 26*a*, 28*a*, 30*a*. Moreover, each of the first, second, third, and fourth links 24, 26, 28, 30 may be an elongated structure. Accordingly, the first link 24 extends along a first longitudinal axis 24*c*. The second link 26 extends along a second longitudinal axis 26*c*. The third link 28 extends along a third longitudinal axis 28*c*. The fourth link 30 extends along a fourth longitudinal axis 30*c*. The first, second, third, and fourth links 24, 26, 28, 30 may be collectively referred to as a linkage 17. The linkage 17 can connect the vehicle door 14 to the vehicle body 12 and includes at least four parallel links (i.e., first, second, third, and fourth links 24, 26, 28, 30). Each of four parallel links (i.e., first, second, third, and fourth links 24, 26, 28, 30) is pivotally connected to the vehicle body 12 and the vehicle door 14. At least two of the links (e.g., first, second, third, and fourth links 24, 26, 28, 30) are offset from each other in two orthogonal directions (e.g., first direction X and second direction Y) to promote kinematic stability of the vehicle door 14 with respect to the vehicle body 12.

The second longitudinal axis 26*c* is spaced apart from the first longitudinal axis 24*c* along the first direction X and the second direction Y. In the depicted embodiment, a first distance D1 is defined from the first longitudinal axis 24*c* to the second longitudinal axis 26*c* along the first direction X when the first and second links 24, 26 are in the first link position (shown in solid lines). However, the first and second longitudinal axes 24*c*, 26*c* remain separated while the first and second links 24, 26 move between the first link position and the second link position. A second distance D2 is defined from the first longitudinal axis 24*c* to the second longitudinal axis 26*c* along the second direction Y. The second distance D2 may be different from the first distance D1.

The third longitudinal axis 28*c* is spaced apart from the fourth longitudinal axis 30*c* along the first direction X and the second direction Y. In the depicted embodiment, a third distance D3 is defined from the third longitudinal axis 28*c* to the fourth longitudinal axis 30*c* along the first direction X when the third and fourth links 28, 30 are in the first link position (shown in solid lines). However, the first and second longitudinal axes 24*c*, 26*c* remain separated the third distance D3 while the third and fourth links 28, 30 move between the first link position and the second link position. A fourth distance D4 is defined from the third longitudinal axis 28*c* to the fourth longitudinal axis 30*c* along the second direction Y. The third distance D3 may be different from the fourth distance D4. The fourth distance D4 may be equal to the second distance D2, and the first distance D1 may be equal to the third distance D3. A fifth distance D5 is defined from the second longitudinal axis 26*c* to the third longitudinal axis 28*c* along the second direction Y. The fifth distance D5 is greater than the first distance D1, the second distance D2, the third distance D3, and the fourth distance D4. The second longitudinal axis 26*c* may not be spaced apart from the third longitudinal axis 28*c* along the second direction X when the second and third links 26, 28 are in the first link position. Thus, the second longitudinal axis 26*c* overlaps the third longitudinal axis 28*c* when the second and third links 26, 28 are in the first link position. A sixth distance D6 is defined from the first longitudinal axis 24*c* to the fourth longitudinal axis 30*c* along the first direction X when the first and fourth links 24, 30 are in the first link position (FIG. 3). The sixth distance D6 is greater than the first distance D1 and the third distance D3. The distances described above allow the hinge assembly 16 to maintain its kinematic stability.

The first link 24 is movably coupled to the first bracket 18 and the second bracket 20. Specifically, the first link end 24*a* of the first link 24 is pivotally coupled to the first bracket 18. A pivot pin 32 extends through the first link end 24*a* of the first link 24 and the first bracket 18 in order to pivotally couple the first bracket 18 to the first link 24. Consequently, the first link 24 can pivot (or rotate) relative to the first bracket 18 about a first axis of rotation 34 that extends through the pivot pin 32 that couples the first bracket 18 to the first link end 24*a* of the first link 24. In other words, the first link 24 is pivotally coupled to the first bracket 18 such that first link 24 is pivotable relative to the first bracket 18 about the first axis of rotation 34.

The first link 24 is also movably coupled to the second bracket 20. Specifically, the second link end 24*b* of the first link 24 is pivotally coupled to the second bracket 20. A pivot pin 32 extends through the second link end 24*b* of the first link 24 and the second bracket 20 and, consequently, pivotally couples the second bracket 20 to the first link 24. As a result, the second bracket 20 can pivot (or rotate) relative to the first link 24 about a second axis of rotation 36 that extends through the pivot pin 32 that couples the second bracket 20 to the second link end 24*b* of the first link 24. In other words, the first link 24 is pivotally coupled to the second bracket 20 such that the second bracket 20 is pivotable relative to the first link 24 about the second axis of rotation 36.

The second link 26 is movably coupled to the first bracket 18. Specifically, the first link end 26*a* of the second link 26 is pivotally coupled to the first bracket 18. A pivot pin 32 extends through the first link end 26*a* of the second link 26 and the first bracket 18, thereby pivotally coupling the first bracket 18 to the second link 26. Accordingly, the second link 26 can pivot (or rotate) relative to the first bracket 18 about a third axis of rotation 38 that extends through the pivot pin 32 that couples the first bracket 18 to the second link 26. In other words, the second link 26 is pivotally coupled to the first bracket 18 such that the second link 26 is pivotable relative to the first bracket 18 about the third axis of rotation 38.

The second link 26 is also movably coupled to the second bracket 20. Specifically, the second link end 26*b* of the second link 26 is pivotally coupled to the second bracket 20. A pivot pin 32 extends through the second link end 26*b* of the second link 26 and the second bracket 20 and, consequently, pivotally couples the second bracket 20 to the second link 26. Therefore, the second bracket 20 can pivot (or rotate) relative to the second link 26 about a fourth axis of rotation 40 that extends through the pivot pin 32 that couples the second bracket 20 to the second link 24. In other words, the second link 26 is pivotally coupled to the second bracket 20 such that the second bracket 20 is pivotable relative to the second link 24 about the fourth axis of rotation 40. The fourth axis of rotation 40 is spaced from the second axis of rotation 36 along the third direction when the first, second, third, and fourth links 24, 26, 28, 30 are in the first link position.

The third link 28 is movably coupled to the first bracket 18. Specifically, the first link end 28*a* of the third link 28 is pivotally coupled to the first bracket 18. A pivot pin 32 extends through the first link end 28*a* of the third link 28 and the first bracket 18, thereby pivotally coupling the first bracket 18 to the third link 28. Accordingly, the third link 28 can pivot (or rotate) relative to the first bracket 18 about a fifth axis of rotation 42 that extends through the pivot pin 32 that couples the first bracket 18 to the third link 28. In other words, the third link 28 is pivotally coupled to the first bracket 18 such that the third link 28 is pivotable relative to the first bracket 18 about the fifth axis of rotation 42.

The third link 28 is also movably coupled to the second bracket 20. Specifically, the third link end 28*b* of the third link 28 is pivotally coupled to the second bracket 20. A pivot pin 32 extends through the second link end 28*b* of the third link 28 and the second bracket 20 and, consequently, pivotally couples the second bracket 20 to the third link 28. Therefore, the second bracket 20 can pivot (or rotate) relative to the third link 28 about a sixth axis of rotation 44 that extends through the pivot pin 32 that couples the second bracket 20 to the second link 24. In other words, the third link 28 is pivotally coupled to the second bracket 20 such that the second bracket 20 is pivotable relative to the third link 28 about the sixth axis of rotation 44.

The fourth link 30 is movably coupled to the first bracket 18. Specifically, the first link end 30*a* of the third link 30 is pivotally coupled to the first bracket 18. A pivot pin 32 extends through the first link end 30*a* of the fourth link 30 and the first bracket 18, thereby pivotally coupling the first bracket 18 to the fourth link 30. Accordingly, the fourth link 30 can pivot (or rotate) relative to the first bracket 18 about a seventh axis of rotation 46 that extends through the pivot pin 32 that couples the first bracket 18 to the fourth link 28. In other words, the fourth link 30 is pivotally coupled to the first bracket 18 such that the fourth link 30 is pivotable relative to the first bracket 18 about the seventh axis of rotation 46. The seventh axis of rotation 46 is spaced apart from the fifth axis of rotation 42 along the third direction when the first, second, third, and fourth links 24, 26, 28, 30 are in the first link position.

The fourth link 30 is also movably coupled to the second bracket 20. Specifically, the second link end 30*b* of the fourth link 30 is pivotally coupled to the second bracket 20. A pivot pin 32 extends through the second link end 30*b* of the fourth link 30 and the second bracket 20 and, consequently, pivotally couples the second bracket 20 to the fourth link 30. Therefore, the second bracket 20 can pivot (or rotate) relative to the fourth link 30 about an eighth axis of rotation 48 that extends through the pivot pin 32 that couples the second bracket 20 to the second link 24. In other words, the fourth link 30 is pivotally coupled to the second bracket 20 such that the second bracket 20 is pivotable relative to the fourth link 30 about the eighth axis of rotation 48. The eighth axis of rotation 48 is spaced apart from the sixth axis of rotation 44 along the third direction Z when the first, second, third, and fourth links 24, 26, 28, 30 are in the first link position.

The first, second, third, fourth, fifth, sixth, seventh, and eighth axes of rotation 34, 36, 38, 40, 42, 44, 46, 48 are substantially parallel to each other so as to maintain the kinematic stability of the hinge assembly 16. The first axis of rotation 34 is spaced apart from the third axis of rotation 38 along the third direction Z when the first, second, third, and fourth links 24, 26, 28, 30 are in the first link position. A seventh distance D7 is defined from the first axis of rotation 34 to the third axis of rotation 38 along the third direction Z. An eighth distance D8 is defined from the second axis of rotation 36 to the fourth axis of rotation 40 along the third direction Z when the first, second, third, and fourth links 24, 26, 28, 30 are in the first link position. A ninth distance D9 is defined from the fifth axis of rotation 42 to the seventh axis of rotation 46 along the third direction Z when the first, second, third, and fourth links 24, 26, 28, 30 are in the first link position. A tenth distance D10 is defined from the sixth axis of rotation 44 to the eighth axis of rotation 48 along the third direction Z when the first, second, third, and fourth links 24, 26, 28, 30 are in the first link position. The seventh distance D7, the eighth distance D8, the ninth distance D9, and the tenth distance D10 may be equal or at least substantially equal. The distances described above allow the hinge assembly 16 to maintain its kinematic stability.

During operation, a user may apply a force F to the second bracket 20 in order to rotate the second bracket 20 relative to the first bracket 18 in a first rotational direction R1. As a consequence, the second bracket 20 moves from the first bracket position (shown in solid lines) toward the second bracket position (shown in dashed lines). The second bracket 20 can also move from the second bracket position shown in dashed lines) to the first bracket position (shown in solid lines) in a second rotational direction R2, which is opposite to the first rotational direction R1. The arrangement of the offsets of the first, second, third, and fourth links 24, 26, 28, 30 (as defined above by the distances D1, D3, D6, D7, D8, D9, D10) is sufficient to maintain the smooth operation and stability of the hinge assembly 16 independent of the location of the applied force "F" (FIG. 5) on the vehicle door 14 (or any other vehicle component). Although the drawings show the hinge assembly 16 pivotally interconnecting the vehicle door 14 and the vehicle body 12, it is contemplated that the hinge assembly 16 may be used to pivotally interconnect other components.

While the best modes for carrying out the invention have been described in detail, those familiar with the art to which this invention relates will recognize various alternative designs and embodiments for practicing the invention within the scope of the appended claims.

The invention claimed is:

1. A hinge assembly, comprising:

a first bracket defining a first bracket surface and a second bracket surface opposite the first bracket surface;

a second bracket movably coupled to the first bracket;

a first link pivotally coupled to the first and second brackets, the first link extending along a first longitudinal axis;

a second link pivotally coupled to the first and second brackets, the second link extending along a second longitudinal axis, the second longitudinal axis being spaced from the first longitudinal axis along a first direction orthogonal to the first bracket surface and a second direction perpendicular to the first direction, and the second link being substantially parallel to the first link;

a third link pivotally coupled to the first and second brackets, the third link extending along a third longitudinal axis, and the third link being substantially parallel to the first and second links;

a fourth link pivotally coupled to the first and second brackets, the fourth link extending along a fourth longitudinal axis, the fourth link being substantially parallel to the first, second, and third links, the third longitudinal axis being spaced from the fourth longitudinal axis along the first direction, and the fourth longitudinal axis being spaced from the third longitudinal axis along the second direction; and wherein each of the first, second, third, and fourth links is pivotally coupled to the first and second brackets such that the second bracket is movable relative to the first bracket between a first bracket position and a second bracket position.

2. The hinge assembly of claim 1, wherein the first, second, third, and fourth links are movable simultaneously relative to the first bracket between a first link position and a second link position, the first, second, third, and fourth links are in the first link position when the second bracket is in the first bracket position, and the first, second, third, and fourth links are in the second link position when the second bracket is in the second bracket position.

3. The hinge assembly of claim 2, wherein a first distance is defined from the first longitudinal axis to the second longitudinal axis along the first direction when the first and second links are in the first link position, and a second distance is defined from the first longitudinal axis to the second longitudinal axis along the second direction, a third distance is defined from the third longitudinal axis to the fourth longitudinal axis along the first direction when the third and fourth links are in the first link position, and the third distance is equal to the first distance.

4. The hinge assembly of claim 3, wherein a fourth distance is defined from the third longitudinal axis to the fourth longitudinal axis along the second direction, and the fourth distance is equal to the second distance.

5. The hinge assembly of claim 4, wherein a fifth distance is defined from the second longitudinal axis to the third longitudinal axis along the second direction, and the fifth distance is greater than the first distance, the second distance, the third distance, and the fourth distance.

6. The hinge assembly of claim 5, wherein a sixth distance is defined from the first longitudinal axis to the fourth longitudinal axis along the first direction when the first and fourth links are in the first link position, and the sixth distance is greater than the first distance and the third distance.

7. The hinge assembly of claim 6, wherein the first link is pivotally coupled to the first bracket such that the first link is pivotable relative to the first bracket about a first axis of rotation, the first link is pivotally coupled to the second bracket such that the second bracket is pivotable relative to the first link about a second axis of rotation, and the second link is pivotally coupled to the first bracket such that the second link is pivotable relative to the first bracket about a third axis of rotation, and the first axis of rotation is spaced apart from the third axis of rotation along a third direction perpendicular to the first direction and the second direction.

8. The hinge assembly of claim 7, wherein the second link is pivotally coupled to the second bracket such that the second bracket is pivotable relative to the second link about a fourth axis of rotation, and the fourth axis of rotation is spaced from the second axis of rotation along the third direction when the first, second, third, and fourth links are in the first link position.

9. The hinge assembly of claim 8, wherein the third link is pivotally coupled to the first bracket such that the third link is pivotable relative to the first bracket about a fifth axis of rotation, the third link is pivotally coupled to the second bracket such that the second bracket is pivotable relative to the third link about a sixth axis of rotation, the fourth link is pivotally coupled to the first bracket such that the fourth link is pivotable relative to the first bracket about a seventh axis of rotation, and the seventh axis of rotation is spaced apart from the fifth axis of rotation and is spaced apart along the third direction when the first, second, third, and fourth links are in the first link position.

10. The hinge assembly of claim 9, wherein the fourth link is pivotally coupled to the second bracket such that the second bracket is pivotable relative to the fourth link about an eighth axis of rotation, and the eighth axis of rotation is spaced apart from the sixth axis of rotation along the third direction when the first, second, third, and fourth links are in the first link position.

11. The hinge assembly of claim 10, wherein the first, second, third, fourth, fifth, sixth, seventh, and eighth axes of rotation are substantially parallel to each other.

12. A vehicle, comprising:

a vehicle body;

a vehicle panel movably coupled to the vehicle body;

a hinge assembly movably coupling the vehicle panel to the vehicle body such that the vehicle panel is movable relative to the vehicle body between a closed position and an open position, wherein the hinge assembly includes:

a first bracket coupled to the vehicle body, the first bracket defining a first bracket surface and a second bracket surface opposite the first bracket surface;

a second bracket coupled to the vehicle panel;

a first link pivotally coupled to the first and second brackets, the first link extending along a first longitudinal axis;

a second link pivotally coupled to the first and second brackets, the second link extending along a second longitudinal axis, the second link being substantially parallel to the first link, wherein the second longitudinal axis is spaced from the first longitudinal axis along a first direction orthogonal to the first bracket surface, the second longitudinal axis is spaced from the first longitudinal axis along a second direction perpendicular to the first direction, a first distance is defined from the first longitudinal axis to the second longitudinal axis along the first direction when the first and second links are in a first link position, and a second distance is defined from the first longitudinal axis to the second longitudinal axis along the second direction;

a third link pivotally coupled to the first and second brackets, the third link extending along a third longitudinal axis, the third link being substantially parallel to the first and second links;

a fourth link pivotally coupled to the first and second brackets, the fourth link extending along a fourth longitudinal axis, the fourth link being substantially parallel to the first, second, and third links, wherein the third longitudinal axis is spaced from the fourth longitudinal axis along the first direction, and the fourth longitudinal axis is spaced from the third longitudinal axis along the second direction, a third distance is defined from the third longitudinal axis to the fourth longitudinal axis along the first direction when the third and fourth links are in the first link position, the third distance is equal to the first distance, a fourth distance is defined from the third longitudinal axis to the fourth longitudinal axis along the second direction, the fourth distance is equal to the second distance, a fifth distance is defined from the second longitudinal axis to the third longitudinal axis along the second direction, and the fifth distance is greater than the first distance, the second distance, the third distance, and the fourth distance;

wherein each of the first, second, third, and fourth links pivotally interconnects the vehicle panel and the vehicle body through the first and second brackets such that the vehicle panel is movable relative to the vehicle body between the closed position and the open position; and wherein the first, second, third, and fourth links are movable simultaneously relative to the first bracket between the first link position and a second link position, the first, second, third, and fourth links are in the first link position when the second bracket is in a first bracket position, and the first, second, third, and fourth links are in the second link position when the second bracket is in a second bracket position.

13. The vehicle of claim 12, wherein a sixth distance is defined from the first longitudinal axis to the fourth longitudinal axis along the first direction when the first and fourth links are in the first link position, and the sixth distance is greater than the first distance and the third distance.

14. The vehicle of claim 13, wherein the first link is pivotally coupled to the first bracket such that first link is pivotable relative to the first bracket about a first axis of rotation, the first link is pivotally coupled to the second bracket such that the second bracket is pivotable relative to the first link about a second axis of rotation, and the second link is pivotally coupled to the first bracket such that the second link is pivotable relative to the first bracket about a third axis of rotation, and the first axis of rotation is spaced apart from the third axis of rotation along a third direction perpendicular to the first direction and the second direction.

15. A vehicle, comprising:

a vehicle body;

a vehicle door movably coupled to the vehicle body;

a hinge assembly movably coupling the vehicle door to the vehicle body such that the vehicle door is movable relative to the vehicle body between a closed position and an open position, wherein the hinge assembly includes:

a first bracket coupled to the vehicle body, the first bracket defining a first bracket surface and a second bracket surface opposite the first bracket surface;

a second bracket coupled to the vehicle door;

a first link pivotally coupled to the first and second brackets, the first link extending along a first longitudinal axis;

a second link pivotally coupled to the first and second brackets, the second link extending along a second longitudinal axis, the second longitudinal axis being spaced from the first longitudinal axis along a first direction orthogonal to the first bracket surface and a second direction perpendicular to the first direction when the vehicle door is in the open position, and the second link being substantially parallel to the first link;

a third link pivotally coupled to the first and second brackets, the third link extending along a third longitudinal axis, the third link being substantially parallel to the first and second links;

a fourth link pivotally coupled to the first and second brackets, the fourth link extending along a fourth longitudinal axis, the fourth link being substantially parallel to the first, second, and third links; and wherein each of the first, second, third, and fourth links pivotally interconnects the vehicle door and the vehicle body through the first and second brackets such that the vehicle door is movable relative to the vehicle body between the closed position and the open position.

* * * * *